US007631469B2

(12) United States Patent
Prout et al.

(10) Patent No.: US 7,631,469 B2
(45) Date of Patent: Dec. 15, 2009

(54) SPACING DEVICE

(76) Inventors: Dennis Raymond Prout, Apartment 606/28 College Hill Freemans Bay, Auckland (NZ) 1011; Mark Neville Biddle, 44 Brigham Young Drive, Auckland (NZ) 1311

( * ) Notice: Subject to any disclaimer, the term of this patent is extended or adjusted under 35 U.S.C. 154(b) by 206 days.

(21) Appl. No.: 11/631,498

(22) PCT Filed: Jul. 5, 2005

(86) PCT No.: PCT/NZ2005/000161

§ 371 (c)(1),
(2), (4) Date: Apr. 6, 2007

(87) PCT Pub. No.: WO2006/004446

PCT Pub. Date: Jan. 12, 2006

(65) Prior Publication Data

US 2008/0135712 A1 Jun. 12, 2008

(30) Foreign Application Priority Data

Jul. 6, 2004 (NZ) ..... 533948
Dec. 23, 2004 (NZ) ..... 537376

(51) Int. Cl.
*E04B 2/00* (2006.01)

(52) U.S. Cl. ..... 52/506.06; 52/506.07; 52/506.08; 248/343

(58) Field of Classification Search ..... 52/506.06, 52/506.07, 506.08, 745.05, 22, 235, 327, 52/328, 331; 248/343
See application file for complete search history.

(56) References Cited

U.S. PATENT DOCUMENTS

| | | | | |
|---|---|---|---|---|
| 3,207,057 | A * | 9/1965 | Brown et al. | 454/301 |
| 3,619,960 | A * | 11/1971 | Thompson | 52/241 |
| 3,685,235 | A * | 8/1972 | Lang | 52/39 |
| 4,027,454 | A * | 6/1977 | Schuplin | 52/714 |
| 4,470,239 | A * | 9/1984 | Sauer | 52/777 |
| 4,640,064 | A * | 2/1987 | Goodworth, II | 52/506.08 |
| 4,674,254 | A * | 6/1987 | Koehler et al. | 52/506.06 |
| 4,679,375 | A * | 7/1987 | Shirey | 52/777 |
| 5,253,463 | A * | 10/1993 | Witmyer | 52/506.07 |
| 5,809,730 | A * | 9/1998 | Renz | 52/506.09 |
| 6,338,228 | B1 * | 1/2002 | Chevalier | 52/220.6 |
| 6,481,173 | B1 * | 11/2002 | Roy et al. | 52/506.07 |
| 6,758,627 | B2 | 7/2004 | King | |
| 6,920,732 | B2 * | 7/2005 | Mårtensson | 52/586.1 |
| 7,293,393 | B2 * | 11/2007 | Kelly et al. | 52/665 |
| 2002/0152704 | A1 * | 10/2002 | Thompson et al. | 52/506.06 |

(Continued)

FOREIGN PATENT DOCUMENTS

DE 3116152 A1 11/1982

(Continued)

*Primary Examiner*—Richard E Chilcot, Jr.
*Assistant Examiner*—Mark R Wendell
(74) *Attorney, Agent, or Firm*—Frank H. Foster; Kremblas, Foster, Phillips & Pollick

(57) ABSTRACT

Spacing device has a body (2) and at least two guiding flanges (3, 4) which extend from the upper surface (5) of the body. The flanges are spaced approximately the width of the support means and are configures to locate the support means and the spacing body with respect to the mounting means. The spacing device can be used in ceiling.

25 Claims, 6 Drawing Sheets

U.S. PATENT DOCUMENTS

| | | | | |
|---|---|---|---|---|
| 2003/0106276 | A1* | 6/2003 | Tallman et al. | 52/506.06 |
| 2003/0213199 | A1* | 11/2003 | Bongio et al. | 52/506.01 |
| 2004/0231271 | A1* | 11/2004 | Bruno | 52/506.06 |
| 2004/0231279 | A1* | 11/2004 | Sobek | 52/716.1 |
| 2005/0086888 | A1* | 4/2005 | Moore et al. | 52/506.06 |

FOREIGN PATENT DOCUMENTS

| | | | |
|---|---|---|---|
| GB | 2358881 | A | 8/2001 |
| JP | 2003164230 | | 10/2003 |

* cited by examiner

SPACING DEVICE

TECHNICAL FIELD

This invention relates to a spacing device. In particular, though not solely, it relates to a spacing device used in the construction of ceiling systems, and more particularly, suspended ceiling systems.

BACKGROUND ART

Suspended ceiling systems are common in residential and commercial premises. These systems comprise a ceiling grid which is suspended at ceiling level by rods, solid hangers or wires from a structure forming part of the building.

The ceiling grid forms a network in a horizontal (or slightly inclined or sometimes vertical) plane of interconnected longitudinal and transverse bearers (or nogs and main rails) which, once constructed and installed, form an array adapted to receive and securely retain ceiling tiles. The ceiling tiles may have rebated or tegular edges and each tile may be retained within an opening in the ceiling grid by virtue of the contact made between the rebated or tegular edges of the tile and the network of bearers which surround the opening in which the tile is placed. Accordingly, a single ceiling grid network is generally adapted to support the weight of a number of ceiling tiles positioned therein.

During the installation of the ceiling system, the ends of each bearer of the ceiling grid network must be secured to a wall (that is, at the location where the ceiling meets the wall) via wall trims. Wall trims are typically "L"-shaped extrusions running the length of the walls which have a vertical portion fixed to a wall whilst the end of each bearer of the ceiling grid network is cantilevered by a horizontal portion of the wall trim which projects out from the wall.

Inevitably, in suspended ceiling systems which utilise rebated or recessed edge tiles, the tiles adjacent a wall need to be cut to fit a space smaller than the size of a tile—a process which removes the rebate from the tile's edge adjacent the wall. It is therefore desirable to raise the ceiling grid network relative to the wall trim, in the region adjacent to walls, so that the ceiling tiles located within the ceiling grid at the wall perimeter are properly supported by both the ceiling grid and the wall trim and no unsightly gaps are introduced between tile and ceiling grid. Such a provision ensures that the ceiling grid, the tiles and the wall trim are correctly aligned with respect to one another with regard to cut tiles placed adjacent a wall. Alternatively, the cut edge could be hand or machine rebated but this operation is time consuming, requires a high degree of skill and compromises the structural integrity of the tile's edge.

A current method of raising the ceiling grid network is to "crimp" the end of each bearer of the ceiling grid that connects with the wall trim. "Crimping" involves bending or pressing the end of the bearer to form a ridge, where the ridge formed raises the ceiling grid with respect to the wall trim as required. This enables the non-rebated edge of the tile to sit on the horizontal portion of the wall trim while enabling the bearers along the tile edge perpendicular to the wall trim to contact and thereby support those edges of the tile.

However, "crimping" as it is used in the installation of suspended ceiling systems, is a specialist task in the trade. It is highly labour intensive and time consuming to perform and requires great skill to ensure a quality finish to wall components is provided. Furthermore, over a period of time the "crimped" ends of the bearer are liable to weaken due to the weight of the suspended ceiling that the "crimped" end is supporting. This can cause the wall trim to bend which has the effect of causing the ceiling grid system to warp at places, especially in the region of the wall perimeter, the effect of which is unsightly and destroys the aesthetics of the ceiling.

Similarly, in premises having suspended ceiling systems and partition walls it is necessary to ensure that the gap that forms between the top of a partitioning wall and the ceiling grid bearers and tiles is a consistent distance. To achieve such an installation small blocks of wood or similar type spacing means are often placed on the top of the partitioning wall. However, such an approach does not contribute positively to the aesthetic finish of the ceiling system.

It is therefore an object of the present invention to provide a spacing device for a suspended ceiling system which goes at least some way toward overcoming the above disadvantages or which will at least provide the industry with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein; this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

DISCLOSURE OF INVENTION

Accordingly, in a first aspect of the present invention there is provided a spacing device for locating the position of a support means to a mounting means, said support means having a lower surface bounded by edges, the spacing device including a spacing body, and at least two guiding flanges which extend from an upper surface of the spacing body and which are spaced apart by approximately the width of the support means, the flanges being configured to locate the support means and spacing body with respect to a mounting means.

In another aspect, there is a method of locating the position of a support means relative to a mounting means, wherein the support means has a lower surface bounded by edges, characterised by the steps of:

a) positioning a spacing body having guiding flanges between a lower surface of the support means and an upper surface of the mounting means, and b) aligning the spacing body so that the edges of the support means are positioned between and adjacent to the guiding flanges of the spacing body, and c) Securing the spacing body to the mounting means and/or the supporting means with a connector.

In some other embodiments of the method described above, there is the additional step of compressing a compressible buffer on one end of the spacing device to abut the opposite end of the spacing device engaged with a lip of the mounting means, prior to securing the spacing body to the mounting means and/or the supporting means with a connector.

Preferably, the support means is a bearer of a suspended ceiling system.

Preferably, the mounting means is formed by at least part of a wall trim element.

Preferably, the mounting means may be formed by a horizontal surface of a wall trim element.

Alternatively, the mounting means is the top surface of a partitioning wall.

Preferably, the spacing body is capable of being penetrable by a connector means.

Preferably, the guiding flanges are made of a flexible resilient material.

Preferably, the guiding flanges are formed from an inverted "L"-shape element so as to flexibly clip onto the support means.

Alternatively, the guiding flanges are inwardly tapered.

Preferably, the spacing body is tapered at one end.

Preferably, the spacing body is configured so that the tapered outward facing end of the spacing body is placed in substantial alignment with the outermost edge of the mounting means.

Preferably, the projection, in the form of a buffer, is attached to an end face of the spacing body.

In a further preferred embodiment the buffer is attached to the opposite face from the tapered face.

Preferably, the buffer is compressible.

Alternatively the buffer may be cut, moulded, shaved or otherwise configured to achieve the required dimensions.

Preferably, a buffer is formed from a flexible resilient material.

Preferably, the buffer is provided in the form of at least one fin.

Preferably, a fin projects at an angle to the rear surface of the spacing body.

Preferably, a fin includes a lobe attached to the distal end.

Alternatively the buffer may be configured as a convex element.

Preferably the convex element is constructed of flexible resilient material so as to provide the "compression" or cushioning effect desired to counter any gaps between the spacing device and the vertical section of the wall trim.

Additionally, the convex element can be configured to include flexible joints to aid provision of the cushioning effect.

Preferably one or more of the rear corners of the upper surface of the spacing body are bevelled.

Preferably, the bevelled corners define recesses configured to accept a compressible buffer when the buffer is impacted or forced to be angularly compressed.

Preferably, the spacing body has a frangible portion.

Preferably the spacing body includes or defines a base projection.

Preferably a base projection can be located on a lower surface of the spacing body.

Preferably, the lower surface (base) of the spacing body has a base projection extending from the lower edge of the rear surface of the spacing body at least partially toward the front edge.

Preferably, at least one of the corners of the base projection is bevelled so that the load is distributed toward the rear of the spacing body so as to be supported closely to the wall.

Preferably, the width of the spacing device is within the range 10 millimetres to 30 millimetres.

Preferably, the width of the spacing device is within the range 15 millimetres to 24 millimetres Preferably, the height of the spacing device is within the range 3 millimetres to 20 millimetres.

Preferably, the height of the spacing device is within the range 6 millimetres to 9 millimetres.

In a further aspect, the invention may be broadly said to consist in a ceiling grid comprising bearers and wall trim and the spacing device discussed above, positioned between the wall trim and at least one of the bearers.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
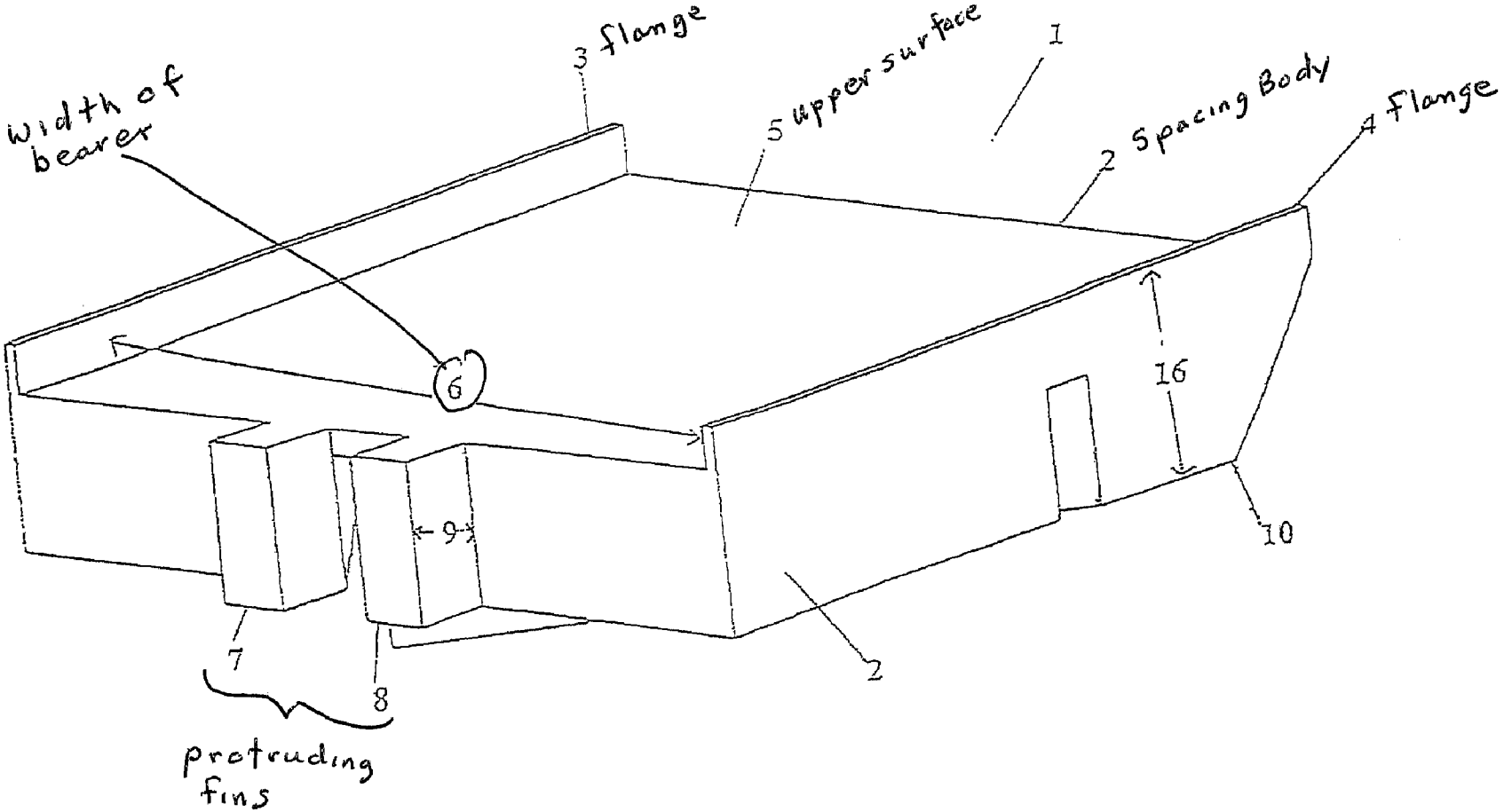
FIG. 1 is a perspective view showing the spacing device in accordance with a preferred embodiment of the present invention.

With reference initially to FIG. 1, a spacing device 1 formed in accordance with a preferred embodiment of the present invention is shown. The device 1 includes a spacing body 2 with extending guiding flanges 3 and 4 which are adapted to locate the spacing device 1 with respect to a bearer, such as ceiling grid network 30 which is used in the construction and installation of a suspended ceiling network.

The spacing body 2 includes upper surface 5 upon which a longitudinal bearer 30 (or nog) of a ceiling grid may be received. The guiding flanges 3 and 4 are adapted to secure the position of the bearer on upper surface 5. The width 6 of the spacing body 2 is determined by the width of the bearer which is to be received on the upper surface 5. For example, if the width of the bearer is approximately 20 millimetres then the width 6 of the spacing body 2 will also be substantially 20 millimetres. In general, suspended ceiling bearers come in only a few predetermined widths and therefore the spacing device can be provided in versions to suit each width.

The spacing device 1 may be used with a connector 34 which is adapted to fix the spacing device 1 to a bearer. Alternatively, or in addition, the connector 35 may be configured to fix the spacing device 1 to a mounting means formed as an "L"-shaped extrusion wall trim 33 connectable to a wall surface at the ceiling level. In an alternative embodiment the mounting means may be a top surface of a partitioning wall used to partition a room into one or more separate adjoining compartments or areas.

The connector 34 may be a nail, screw, rivet or other fastener which may be inserted through the bearer once it has been positioned on surface 5. A hole may be provided in the spacing device to assist insertion of the connector. Once inserted, the connector 34 will protrude through the bearer and into the surface 5 to secure the bearer with respect to the spacing device. Alternatively, the connector 35 may be inserted through the underside horizontal portion of the wall trim and into the underside of spacing device 1 to facilitate its secure connection.

It is therefore necessary for the spacing body to be capable of being penetrated by such connectors as nail, screw, rivets and the like. The spacing device may be constructed from plastic composites, wood, metal or rubber based products or combination thereof. The provision of the guiding flanges 3 and 4 will also serve to prevent undesirable movement (such as spinning) of the spacing device 1 during connection to a ceiling grid bearer, the wall trim and/or a partitioning wall.

In use a user aligns the spacing body to a bearer 30 using the guiding flanges 3,4 and slides it along the bearer 30 until it is positioned on the wall trim 33. The spacing device may then be fixed to the bearer by the connector 34,35.

For example, the guiding flanges may alternatively be of an inverted "L"-shape in which the spacer can "clip" onto the bearer for positioning purposes. These modified flanges help the spacer maintain its position on the bearer and can be of varying dimensions or different material construction to provide some flexible resilience as suitable for each application.

When installed on the wall trim or partitioning the spacing device 1 will raise the level of the end of the longitudinal bearer of the ceiling grid in the region adjacent to the wall (with respect to the wall trim or wall partitioning), thereby ensuring that the tiles and ceiling grid are correctly aligned without gaps therebetween. Using the spacing device 1 will effectively remove the necessity to "crimp" the end of the longitudinal bearer of the ceiling grid that connects with the wall trim. Similarly, use of the device 1 in conjunction with wall partitions will replace the need for small blocks of wood or similar type spacing means to be used and the need to hand or machine rebate the cut edge from rebated edge ceiling panels.

The spacing device 1 may optionally include a rear buffer which in one embodiment consist of protruding fins 7 and 8 (which have a depth 9). When the spacing device 1 is positioned on the horizontal portion of a wall trim the fins 7 and 8 will abut (that is, be hard up against) the wall trims vertical portion (directly adjacent the wall). By appropriately configuring the depth 9 of the fins 7 and 8 the tapered outward facing edge 10 of the spacing device 1 may be placed in substantial alignment with the corresponding outermost edge of the (horizontal portion of the) wall trim. Accordingly, the depth 9 of the fins 7 and 8 will be determined by the depth of the horizontal aspect of the wall trim. Similarly, the height 16 of the spacing device 1 may be determined by the height of the tile or the height of the rebated edge of the tile.

Figure 3:
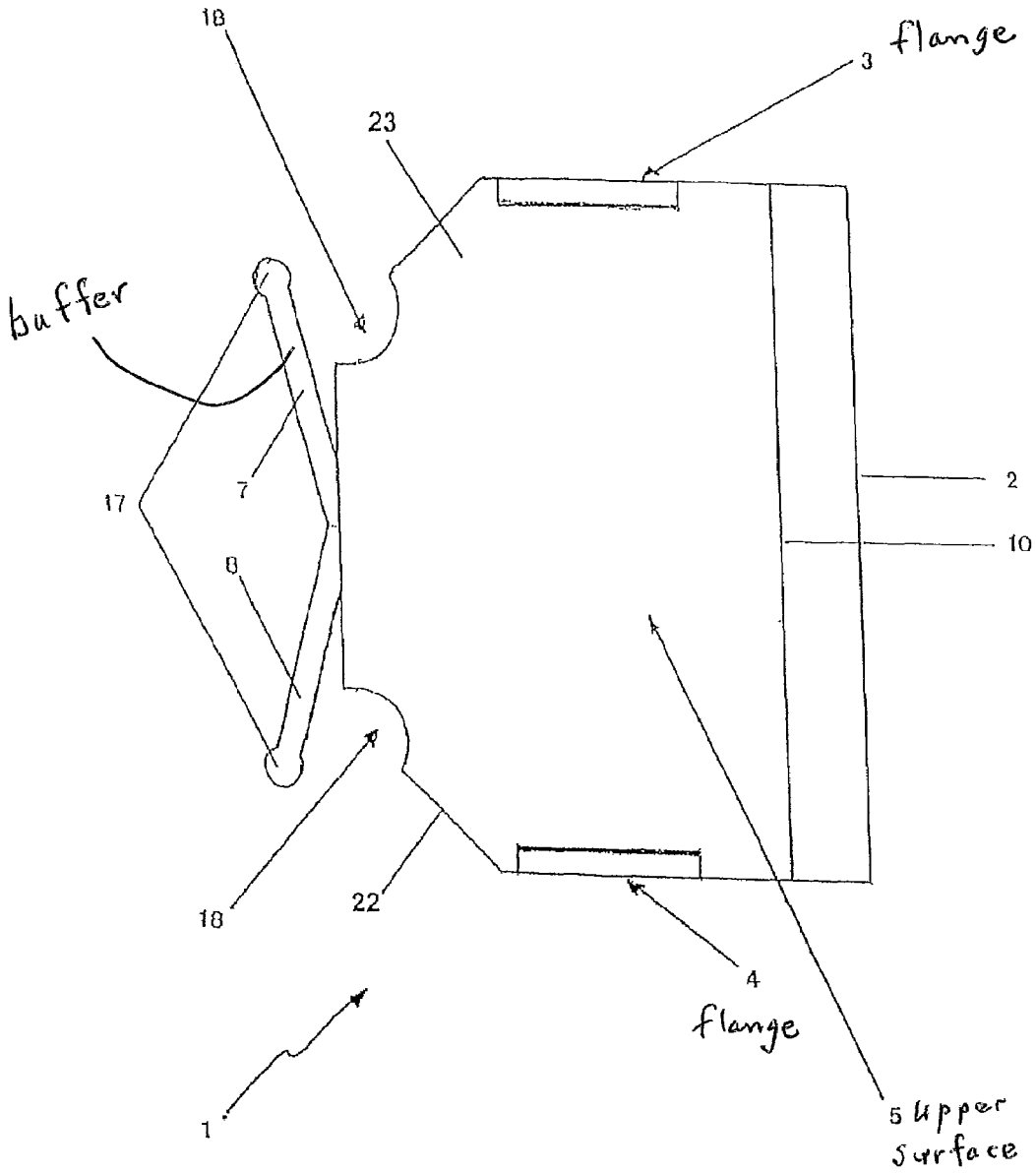
FIG. 3 is a top view illustrating an alternative embodiment of the spacing device of FIG. 1.
Figure 4:
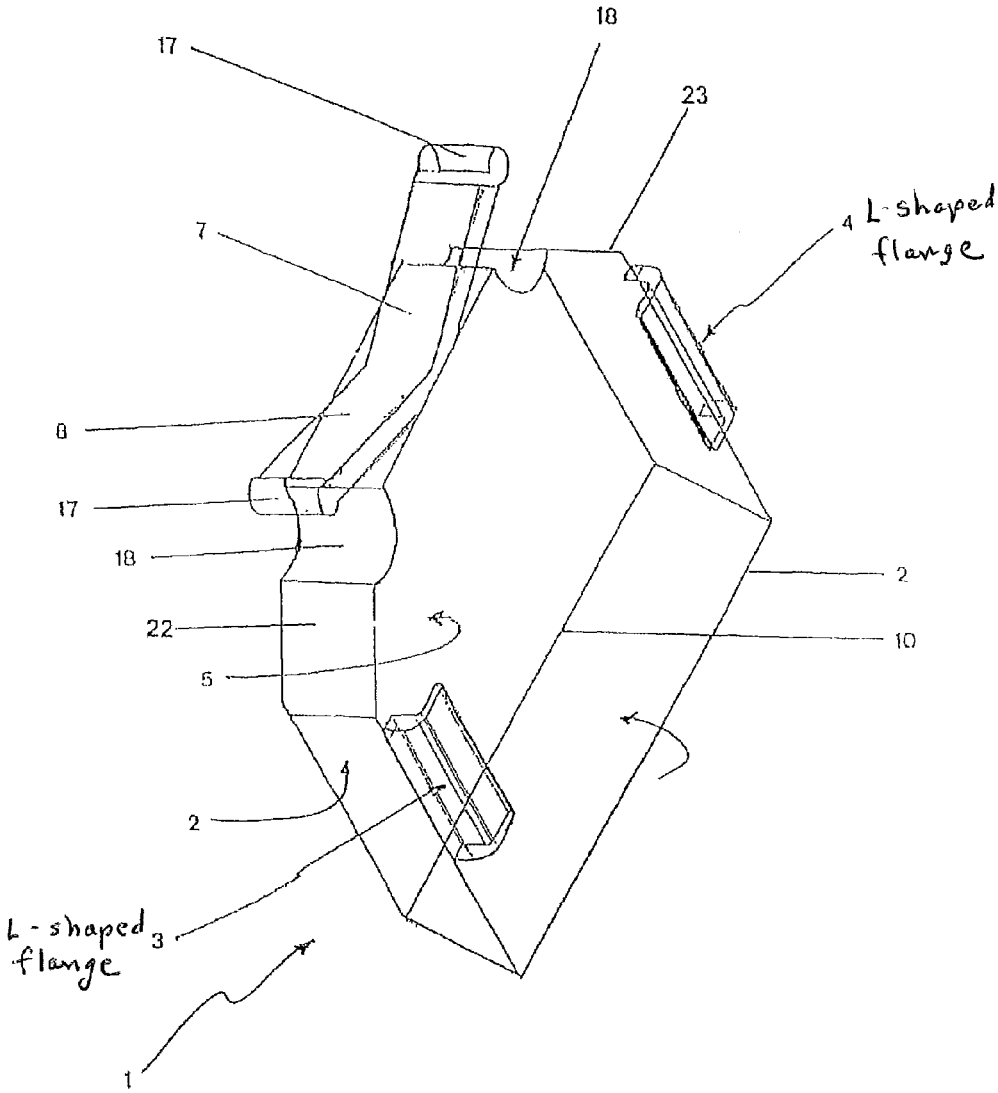
FIG. 4 is a perspective view showing the spacing device of FIG. 3.

In a further embodiment, the rear buffer may be formed from rearward facing projecting fins 7 and 8, which project at an angle to the rear surface or wall of the spacer, as shown in FIGS. 3 and 4.

The fins 7 and 8 are designed to be resiliently flexible and have a degree of elastic "suspension" which allows the spacer to maintain its fitted location and as a level of wall trim gap redundancy (as the gap can often vary according to build quality or linear quality of materials used).

The fins 7 and 8 may include lobes 17 at their respective ends which are able to be housed in recesses 18 if the fins are impacted or forced to be angularly compressed, say for example where the gap between the horizontal portion of wall trim and spacing device is reduced.

Figure 5:
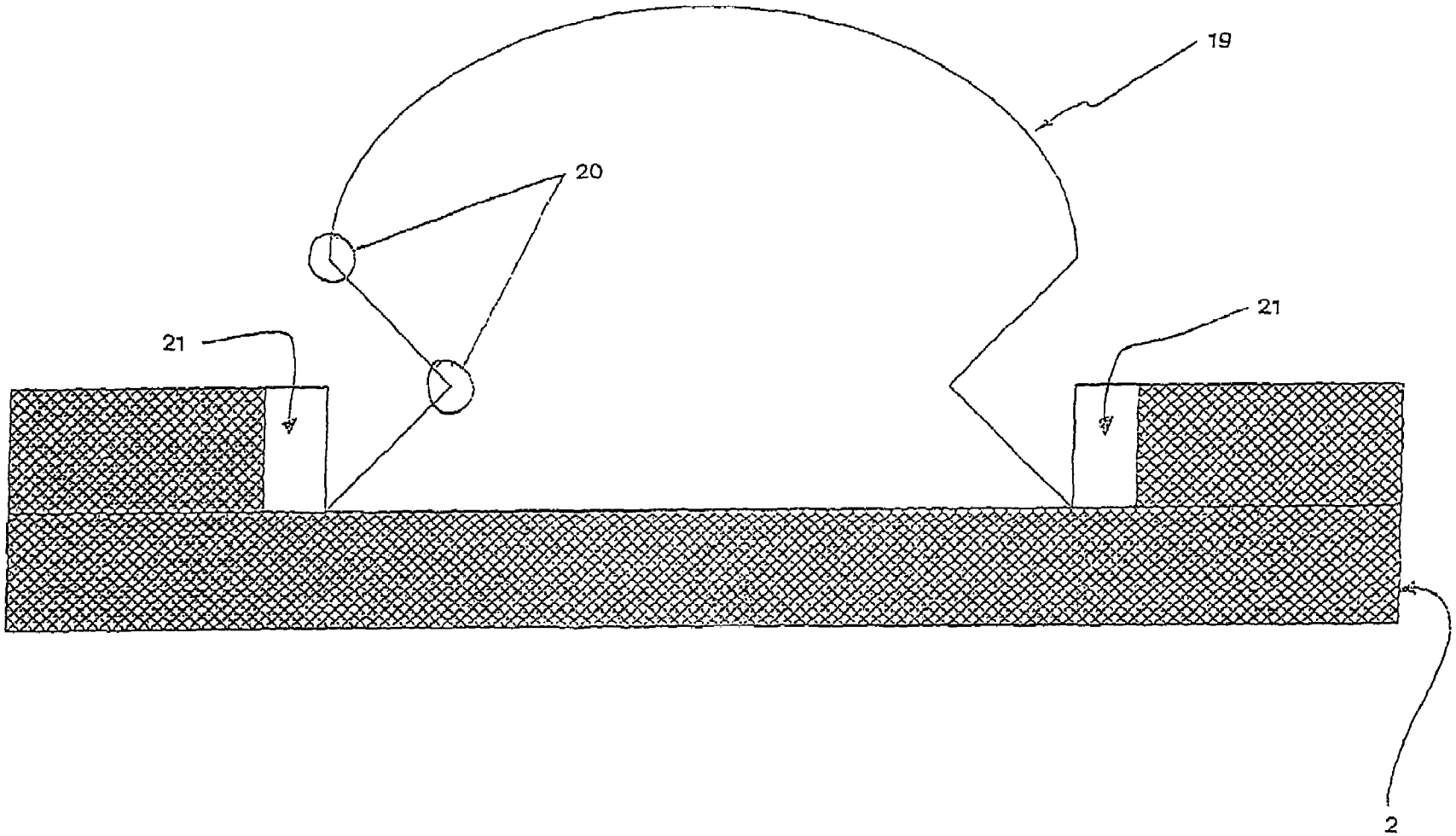
FIG. 5 is a rear end portion view showing the spacing device of an even further embodiment.
Figure 6:
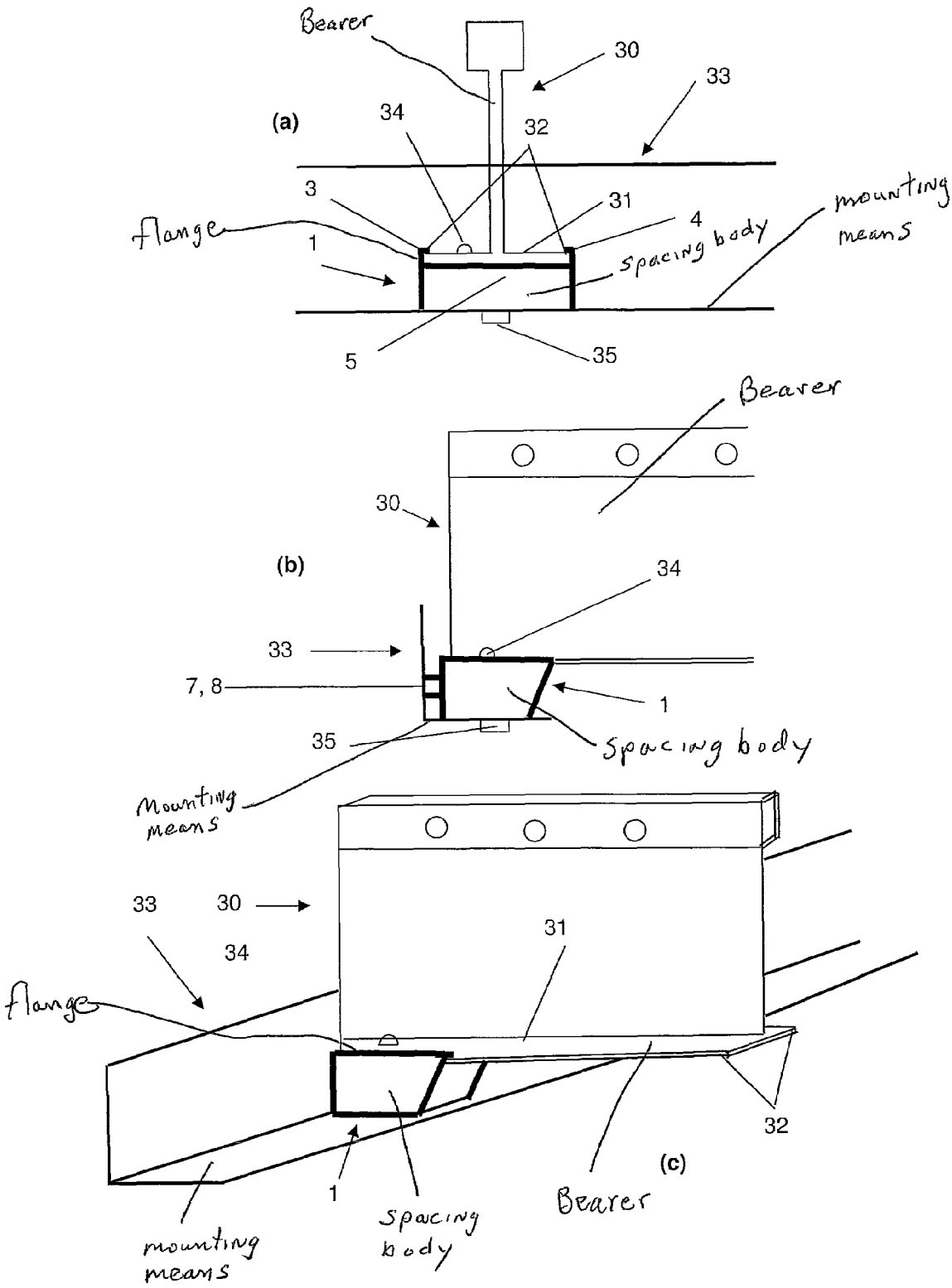
FIG. 6 is a view of the spacing device of FIG. 1 in use with a suspended ceiling system, as viewed: (a) from the front of the spacing device; (b) from the side; and (c) a perspective view.

In an alternative embodiment, illustrated in FIG. 5 (in which only the rear end portion of the spacer device is illustrated), the compressible buffer may be configured as a convex element, such as a single substantially "C" or "D" shaped section 19 in which a resiliently flexible portion of material extends from the spacer to provide the "suspension" or cushioning effect desired to counter any gaps between spacer and vertical section of the wall trim.

Again, the compressive buffer 19 may be configured to include flexible joints 20 (to enable buffer compression) and spacer recesses 21 to enable the fin under compression to be suitably housed.

In all embodiments the fins are generally able to be distorted upon application of pressure/force and may be articulated to enable such distortional ability.

Figure 2:
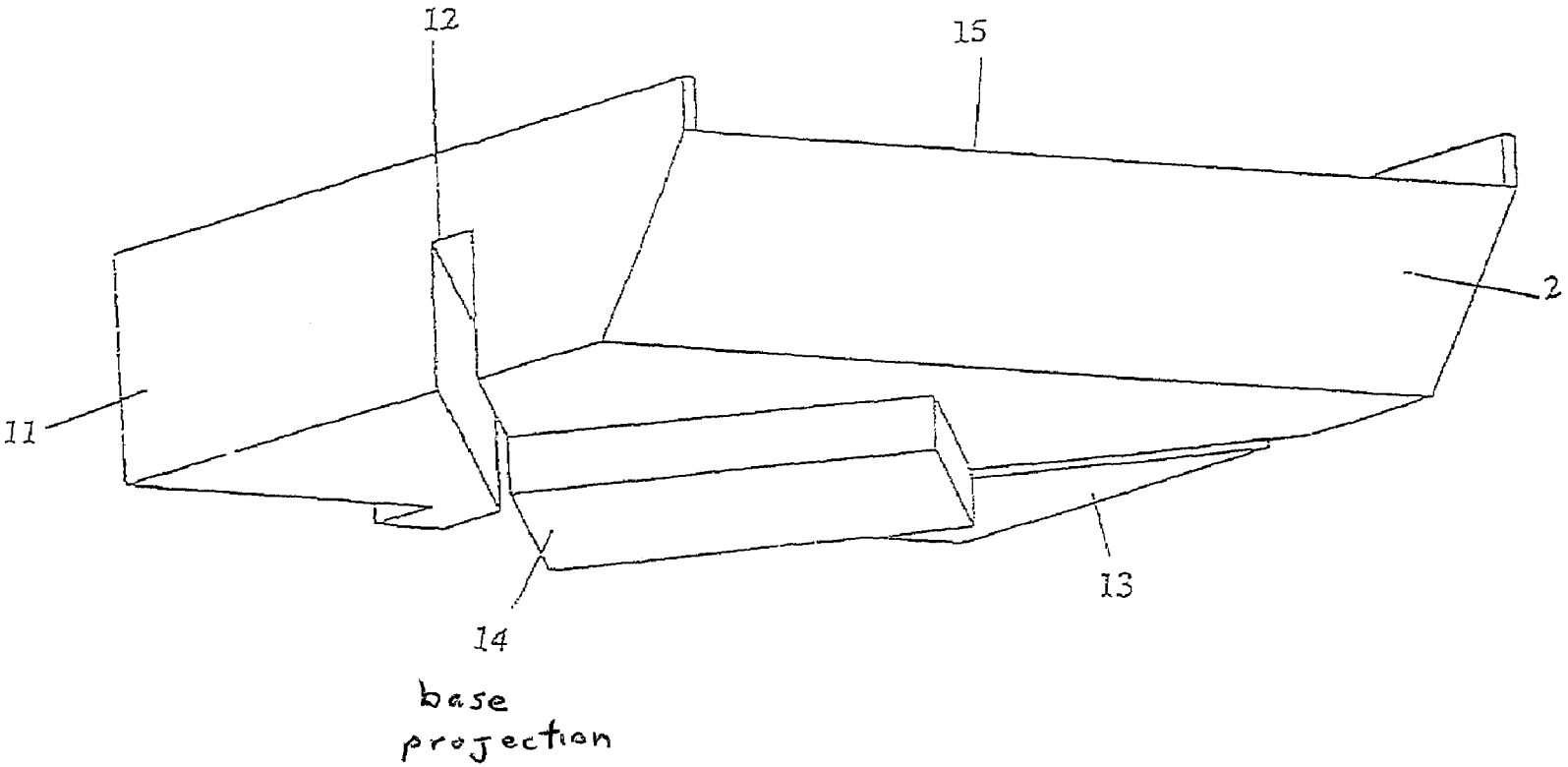
FIG. 2 is a perspective view showing the spacing device of FIG. 1.

FIG. 2 is a perspective view showing the spacing device of FIG. 1.

The front edge 15 of projection 14 is adapted to be abuttingly engaged with an inner edge or lip present on the outward facing edge of the horizontal portion of a wall trim. Such a projection 14 will prevent movement of the spacing device 1 beyond the edge of the wall trim.

Portion 11 of the spacing device 1 may be frangible via angled cut-out section 12 which has a thickness less than that of main portion of the spacing body 2. Portion 13 may also be frangible via an angled cut-out section (not shown) located on the opposite side of the spacing device 1 (the position of which substantially mirrors the location of section 12). Once portions 11 and 12 have been "snapped" off (by hand or pliers for example) the rear of the spacing body 2 may have an angled profile (this feature relates to FIG. 1 and FIG. 2).

In another embodiment the rear corners of surface 5 are bevelled to form the angled profile of faces 22 and 23 of FIGS. 3 and 4.

In use, spacing device 1 may be rotated so that one of the bevelled faces of the spacing device 1 may abut the vertical aspect of the wall trim. This will place the spacing device 1, including surface 5 and guiding flanges 3 and 4 at an angle with respect to the wall trim. Such a provision will enable use of the spacing device 1 when the ceiling grid of the suspended ceiling system is being installed at an angle to the surrounding walls or partitioning wall.

The present invention provides many advantages over the prior art.

The provision of a spacing device 1 which can be efficiently installed at wall junctions and partitions and which eliminates the need to "crimp" the ends of longitudinal bearers used in a suspended ceiling system is of advantage.

The spacing device 1 provides an inexpensive means for raising a ceiling grid in the region of a wall above the level of a wall trim and/or the top of a wall partition so that ceiling tiles are supported by both the ceiling grid and the wall trim or partition thereby ensuring that the ceiling components are correctly aligned with respect to one another when installed.

The spacing device is configured for ease of installation and is suitable for use in varied situations. The spacing device is configured to give a much superior finish as compared with bearers that have been "crimped".

The spacing device 1 may be textured and coloured as required or as desired to enhance the aesthetic appeal of the finish of ceiling system once installed.

In cases where the tiles of an existing suspended ceiling installed in accordance with the present invention are to be changed from rebated edge to flat (without rebate) edge, it is simply necessary to remove the connector (such as by drilling out the rivet), remove the spacing device and install the new tiles. If the ceiling grid components had instead been crimped then the ceiling grid bearers would need to be replaced. Likewise, changing from flat to rebated edge tiles simply requires that the existing connector (such as a rivet) between wall trim and ceiling grid bearer be removed and a spacing device 1 be installed as herein described.

Aspects of the present invention have been described by way of example only and it should be appreciated that modifications and additions may be made thereto without departing from the scope thereof as defined in the appended claims.

We claim:

1. A spacing device for locating the position of a bearer of a suspended ceiling system relative to a mounting means, said bearer having a lower surface bounded by edges, the spacing device comprising:

a spacing body having an upper surface on which a bearer may be received, and at least two parallel guiding flanges which extend upwardly from the upper surface of the spacing body, the guiding flanges being integrally formed with the spacing body and spaced apart by approximately the width between the lower surface edges of the bearer, the flanges being configured in use to locate the bearer on top of the spacing body and wherein the spacing body is configured to be positioned on the mounting means and to raise the level of the bearer with respect to the mounting means.

2. A spacing device as claimed in claim 1 wherein the mounting means is formed from a horizontal surface of a wall trim element.

3. A spacing device as claimed in claim 1 wherein the mounting means is formed from a surface of a partitioning wall.

4. A spacing device as claimed in claim 1 wherein the guiding flanges are made of flexible resilient material.

5. A spacing device as claimed in claim 1 wherein a guiding flange is formed from an inverted "L"-shape element.

6. A spacing device as claimed in claim 1 wherein a guiding flange is inwardly tapered.

7. A spacing device as claimed in claim 1 wherein at least one end of the spacing body is tapered.

8. A spacing device as claimed in claim 1 which includes a buffer integrally formed as part of the spacing device and extending from and associated with an end of the spacing body.

9. A spacing device as claimed in claim 8 wherein the buffer is formed by at least one fin.

10. A spacing device as claimed in claim 9 wherein a fin projects at an angle to the spacing body.

11. A spacing device as claimed in claim 9 wherein a fin is formed from a flexible resilient material.

12. A spacing device as claimed in claim 9 which includes a lobe at one end of a fin.

13. A spacing device as claimed in claim 8 wherein the buffer is configured as a convex element.

14. A spacing device as claimed in claim 1 wherein one or more of the corners of the spacing body are bevelled.

15. A spacing device as claimed in claim 14 wherein the bevelled corners contain recesses configured to accept a compressible buffer.

16. A spacing device as claimed in claim 1 wherein the spacing body includes at least one frangible portion.

17. A spacing device as claimed in claim 1 which includes a base projection projecting downwardly from the spacing body opposite the direction that the parallel guiding flanges extend.

18. A spacing device as claimed in claim 17 wherein the base projection is located on a lower surface of the spacing body.

19. A spacing device as claimed in claim 17 wherein the base projection is located adjacent to a buffer.

20. A spacing device as claimed in claim 17 wherein at least one corner of the base projection is bevelled.

21. A spacing device as claimed in claim 1 wherein the width of the spacing device is within the range 10 millimeters to 30 millimeters.

22. A spacing device as claimed in claim 1 wherein the height of the spacing device is within the range 3 millimeters to 20 millimeters.

23. A method of locating a bearer of a suspended ceiling system relative to a mounting means, wherein the bearer has a lower surface bounded by edges, characterised by the steps of:

i) positioning a spacing device having guiding flanges between a lower surface of the bearer and an upper surface of the mounting means, and ii) aligning the spacing device so that the edges of the bearer are positioned between and adjacent to the guiding flanges of the spacing device, and iii) securing the spacing body to the mounting means or the bearer with a connector.

24. A method of locating a bearer of a suspended ceiling system relative to a mounting means, wherein the bearer has a lower surface bounded by edges, characterised by the steps of:

i) positioning a spacing device having guiding flanges between a lower surface of the bearer and an upper surface of the mounting means, and ii) aligning the spacing device so that the edges of the bearer are positioned between and adjacent to the guiding flanges of the spacing device, and iii) compressing a compressible buffer on one end of the spacing device to abut the opposite end of the spacing device engaged with a lip of the mounting means, and iv) securing the spacing body to the mounting means or the bearer with a connector.

25. An improved suspended ceiling including a mounting means at a plurality of walls and a plurality of bearers extending between opposite mounting means together forming a grid for support of ceiling tiles, the bearers including a lower surface bounded on opposite sides by bearer edges, wherein the improvement is a spacing body locating the position of the bearers at a spaced distance above the mounting means and in an operable orientation comprising:

(a) a lower surface resting upon a mounting means;

(b) an upper surface on which a bearer is received; and (c) at least two parallel guiding flanges extending upwardly from the upper surface of the spacing body, the guiding flanges being integrally formed with the spacing body and spaced apart by approximately the width between the lower surface edges of the bearer, the lower surface of the bearer being positioned between the flanges.

* * * * *